United States Patent [19]

Ritzl

[11] Patent Number: 4,777,772

[45] Date of Patent: Oct. 18, 1988

[54] EXTERNALLY INSULATED WINDOW MOUNTING

[75] Inventor: Antal Ritzl, Zurich, Switzerland

[73] Assignee: Swiss Aluminium Ltd., Chippis, Switzerland

[21] Appl. No.: 40,633

[22] Filed: Apr. 21, 1987

[30] Foreign Application Priority Data

Apr. 25, 1986 [CH] Switzerland ..... 1695/86

[51] Int. Cl.[4] ..... E06B 3/00

[52] U.S. Cl. ..... 52/208; 52/476; 52/717.1

[58] Field of Search ..... 52/208, 476, 716, 717.1; 296/84 R, 84 A, 93, 201

[56] References Cited

U.S. PATENT DOCUMENTS 2,812,558 11/1957 Lobanoff ..... 52/208
3,897,666 8/1975 McClure ..... 52/208 X
4,536,999 8/1985 Eike ..... 52/208
4,703,973 11/1987 Fujikawa ..... 52/717.1
4,723,809 2/1988 Kida et al. ..... 52/208 X

*Primary Examiner*—J. Karl Bell
*Attorney, Agent, or Firm*—Bachman & LaPointe

[57] ABSTRACT

The externally insulated window mounting is employed in the sidewall frame of a railway passenger carriage. This carriage frame comprises sidewall sections and post sections (10), an exchangeable outer skin and in between an insulating material. The window mounting is releasably secured to the sidewall sections and post sections. The inner frame, made up of at least four extrusion pieces spaced from the region of the window corners, features a lip which serves as a sealing surface for the outer skin and holds in place an outer, peripheral frame with undercut groove. A lip on the outer frame pointing away from the window opening, clamps the outer skin securely and holds in place a mounting strip of weather resistant, elastic material to retain the window glazing in place.

12 Claims, 2 Drawing Sheets

EXTERNALLY INSULATED WINDOW MOUNTING

BACKGROUND OF THE INVENTION

The invention relates to an externally insulated window mounting in the sidewall frame of a railway passenger carriage such that the frame of the carriage comprises sidewall and post sections, an exchangeable outer skin and in between an insulating material.

A carriage frame with exchangeable outer skin sheets is described in the European patent publication EP-OS No. 0 148 123. These sheets are on the one hand held loosely in grooves by means of spacers, on the other hand releasably mounted on holding fixtures.

Such an arrangement has the advantage that the carriage frame can be fitted with insulation independent of an interior fitting that has to be installed later and this insulation is consequently not subsequently perforated. This way thermal bridging is avoided later. If a minor accident occurs, the actual load-bearing frame of the vehicle is not damaged, only the insulation and the exchangeable protective skin covering it. In such a case only the damaged panels in the outer skin need to be removed and replaced by new panels.

A conventional material such as glass wool for example can be chosen for the insulation. Other stronger materials which can better withstand moderate impacting are however also available. As all of the insulating material is situated outside the passenger compartment, the safety of the passengers is increased should a fire break out.

Finally, the design of the whole carriage frame cam be favorable influenced by the choice of material for the outer skin.

The object of the invention is therefore to develop an externally insulated window mounting which on the one hand suits to the construction EP-OS No. 0 148 123 and on the other hand satisfies the requirements made of the carriage frame.

SUMMARY OF THE INVENTION

This object is achieved by way of the invention in that the window mounting comprises an inner frame that is releasably secured to the sidewall and post sections and is made up of at least four section lengths situated spaced from the region of the window corners, said inner frame having a lip that acts as a seating for the outer skin, comprising also a peripheral outer frame with an undercut groove to accommodate the insulating washer acting as the releasable attachment to the inner frame, and a profile lip running outwards, pointing away from the window opening for clamping the outer skin securely in place, a peripheral mounting strip that rests against the outer frame and is of a weather resistant, plastic material to accommodate the window glazing, and comprising also an elastic sealing element that is clamped firmly between the inner and outer frames and features a slit to accommodate the outer skin.

The window mounting is situated outside the load bearing construction of the carriage frame and can be dismantled in stages. The same applies to the cover panels of the outer skin secured in the window mounting.

BRIEF DESCRIPTION OF THE DRAWINGS

The invention is described in the following with the aid of drawings of exemplified embodiments. The schematic cross-sections shown are.

DETAILED DESCRIPTION

Figure 1:
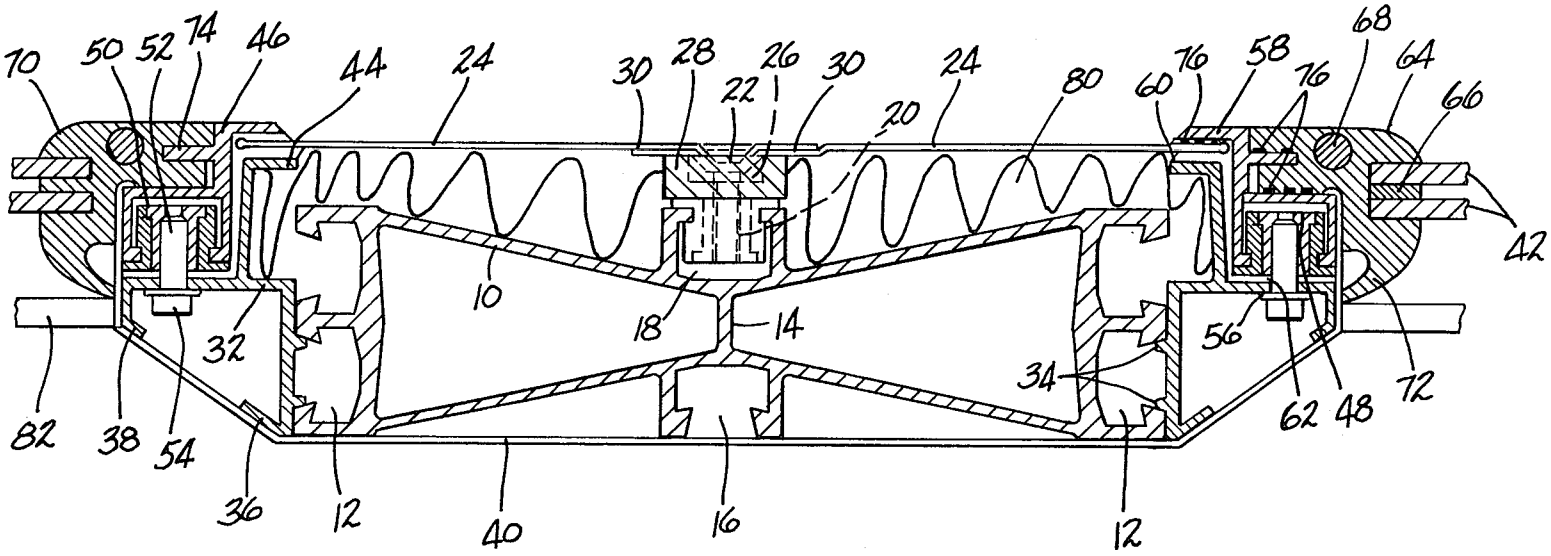
FIG. 1. A horizontal cross section through a window post with window mounting on both sides.

An extruded post section 10 of a conventional aluminum alloy features at both ends two undercut grooves 12 to accommodate releasable fixing means.

Situated in the region of a transverse strut 14 that forms a plane of symmetry are likewise two, outward facing grooves 16, 18. The undercut grooves 16 pointing inwards serves as an anchoring facility for seats, luggage racks, electrical equipment and the like. The undercut groove 18 pointing outwards accommodates insulated washers 20 that, by means of a bolt 22, serve to secure in place in the region of the post section 10 the outer skin 24 comprising two cover panels of an aluminum-plastic laminate. The overlapping panels are drawn by the head of the bolt 22 into the potshaped opening of a bracing piece 28 fitted with an O-ring 26. The overlapping panels of the outer skin 24 are provided with an adhesive layer 30 that prevents the penetration of moisture.

Not shown in the cross-section in FIG. 1 are the mechanical means of securing the inner frame 32 to the end faces of the post section 10. Two longitudinal projections 34 on the inner frame 32 interlock with two correspondingly shaped inner walls of the undercut grooves 12. The heads of bolts introduced into the undercut groove of parallelogram-shaped clamping platelets as described for example in the German Pat. No. 27 51 753 serve as the mechanical means of securement. Also not to be seen here are the holes bored between the projections 34 in the inner frame which allow a threaded pin to be passed through.

The inner frame 32 features two flanges that have angled ends 36, 38 that run at an angle, with the interior covering on them, towards the window glazing 42.

The angled lip 44 of the outward pointing flange of the inner frame 32 forms indirectly, a supporting surface for the outer skin running parallel to the window glazing 42.

The angled lip 44 of the outward pointing flange of the inner frame 32 forms indirectly, a supporting surface for the outer skin running parallel to the window glazing 42.

The outer frame 46 is secured to the inner frame 32 by means of an insulated washer 50 of threaded bush and plastic mantel in an undercut groove 48, and by means of a threaded pin 52 with head 54. A thread for the threaded pin 52 is provided in the inner frame 32. A washer 56 is arranged between the head 54 of the pin 52 and the inner frame 32.

The angled lip 58 of the outer frame 56 extends, pointing away from the window opening, over the edge of the outer skin 24. On tightening the threaded pin 52, not only is the outer frame 46 secured to the inner frame 32 but the section lip 58 clamps the outer skin 24, that has been introduced into a slit in an elastic sealing element 60, against the section lip 44 of the inner frame 32. The gap 62 permits the necessary freedom of movement.

The rubber window strip 64 which, like the outer frame 46 runs around the periphery of the window, releasably accommodates the window glazing 42. This comprises double glazing with insulating sheet 66 of conventional construction Running longitudinally through the mounting strip 64, adjacent to the glazing 42, is a channel which is round in cross-section into which a rubber strand 68, likewise of round cross-section, is introduced by means of a special tool. According to versions of the invention not shown here the channel and the rubber strand 68 can be of different cross-sectional shape, for example quadratic, rectangular, trapezium or elliptical. For the purposes of installing or dismounting the window glazing 42, the rubber strand 68 is removed, whereupon the elastic lip 70 of the mounting strip 64 can be tilted out.

A further lip 72 projecting out from the window strip 64 presses the inner cadding 40 in the region of the window against the inner frame 32.

The mounting strip 64 of rubber is pushed over both sides of a projection 74 on the outer frame 47 running parallel to the glazing 42 and the outer frame is thus prevented from being displaced outwards.

The inner faces of the sealing element 60 and the mounting strip 64 coming into contact with the outer skin 24 and outer frame 46 respectively feature longitudinal grooves 76.

Figure 2:
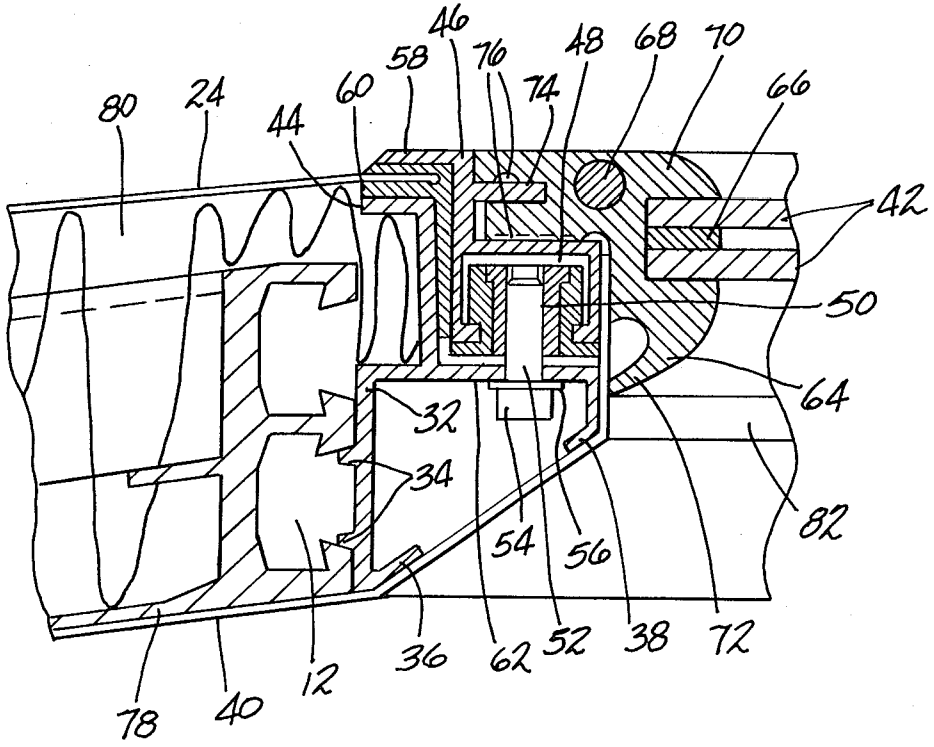
FIG. 2 A vertical section through a window parapet.

The window parapet shown in FIG. 2 corresponds essentially to the left or right side of FIG. 1 as the construction of the window at the sidewall and at the post section is to a large extent the same.

The sidewalls, posts, inner frames and outer frames are preferably extruded aluminum sections of alloys known to the expert in the field.

The outer skin comprises preferably an aluminum or steel sheet; it can however also be of a laminate material, in particular an aluminum-plastic laminate.

It can be seen from the drawings is that the inner frame 32 is not in the form of a closed peripheral frame, but preferably made up of four pieces which do not touch at the round window corners. An inner frame 32 of more than four section pieces is indeed possible but for production reasons is less useful.

The insulating material in the region of the post section 10 and the sidewall section 78 is indicated by the number 80.

What is claimed is:

1. Externally insulated window mounting in the sidewall frame of a railway passenger carriage which comprises a carriage frame having sidewall and post sections, an exchangeable outer skin secured to said frame, an insulating material between said frame and outer skin, window corners for window glazing spaced from said frame, an inner frame releasably secured to the carriage frame made up of at least four section lengths situated spaced from the region of the window corners, said inner frame having a lip that acts as a seating for the outer skin, a peripheral outer frame with an undercut groove therein, an insulating washer in said undercut groove acting as a releasable attachment to the inner frame, and a profile lip running outwards, pointing away from the window corners for clamping the outer skin securely in place, a peripheral mounting strip resting against the outer frame of a weather resistant, elastic material and having means to accommodate the window glazing, and an elastic sealing element clamped firmly between the inner and outer frames and including a slit to accommodate the outer skin.

2. Window mounting according to claim 1 wherein the carriage frame sidewall includes at least one undercut groove.

3. Window mounting according to claim 1 wherein the inner frame includes longitudinal projections which engage by virtue of their shape said carriage frame sidewall undercut groove.

4. Window mounting according to claim 1 including an inner cladding affixed to said carriage frame on the side thereof opposed to said outer skin.

5. Window mounting according to claim 4 wherein the inner frame is inclined towards the window corners and includes angled section ends which form a seating surface for the inner cladding.

6. Window mounting according to claim 1 wherein the insulating washers arranged in the undercut groove of the outer frame have a threaded bush surrounded by a plastic mantel into which engage threaded pins passing through a corresponding hole in the inner frame.

7. Window mounting according to claim 1 wherein the mounting strip is pushed over both sides of a section lip projecting out from the outer frame and running parallel to the window corners.

8. Window mounting according to claim 1 wherein the mounting strip features, adjacent to the window glazing, a groove that opens outwards, runs in the longidudinal direction and into which a rubber strand is introduced.

9. Window mounting according to claim 8 wherein the outwards opening groove and rubber strand are circular in cross-section.

10. Window mounting according to claim 4 wherein a lip projecting out of the mounting strip presses the inner cladding in the region of the window against the inner frame.

11. Window mounting according to claim 1 wherein the sidewall, posts, inner frame and outer frame are of extruded aluminum sections.

12. Window mounting according to claim 1 wherein the outer skin comprises a material selected from the group consisting of aluminum sheet, steel sheet and a laminate panel.

* * * * *